US005870872A

United States Patent [19]

Hinnen et al.

[11] Patent Number: 5,870,872

[45] Date of Patent: Feb. 16, 1999

[54] APPLICATOR FOR CEILING PANELS OF LIGHT TUNNEL

[75] Inventors: Robert T. Hinnen, Kansas City; Norman Jamison, Dearborn, both of Mo.

[73] Assignee: Stuppy, Incorporated, Kansas City, Mo.

[21] Appl. No.: 967,482

[22] Filed: Nov. 11, 1997

[51] Int. Cl.[6] ..... E04F 21/18

[52] U.S. Cl. ..... 52/749.1; 52/86; 52/126.1; 52/745.07; 52/745.08; 52/746.1; 52/747.11; 52/749.11; 182/141; 414/10

[58] Field of Search ..... 52/126.1, 86, 745.07, 52/745.08, 746.1, 747.11, 749.1, 749.11; 182/141; 187/900; 414/10, 11

[56] References Cited

U.S. PATENT DOCUMENTS 3,970,200 7/1976 Goetjen ..... 52/745.07 X 4,064,999 12/1977 Young ..... 52/749.1 X

*Primary Examiner*—Christopehr Kent

*Attorney, Agent, or Firm*—Hovey, Williams, Timmons & Collins

[57] ABSTRACT

A method and apparatus for applying ceiling panels to a light tunnel is provided. The applicator hereof includes a gantry, a frame, and a shifter for vertically shifting said frame relative to said gantry. The frame is presents a pair of generally arcuate spaced-apart rails each having a pair of terminal feet, with a bridge interconnecting the feet. The gantry includes a plurality of towers each having a pair of upright tower legs. The tower legs are attached to a base and preferably further supported by braces to maintain an upright configuration. A shifter is provided to operatively interconnect the gantry and the frame for raising the latter and the panel placed thereon into juxtaposition with a framework of the light tunnel. In accordance with the method, the applicator is placed within the framework of the light tunnel, a panel is placed on the platform, and the platform is shifted to place the panel in position for attachment to the framework.

16 Claims, 5 Drawing Sheets

APPLICATOR FOR CEILING PANELS OF LIGHT TUNNEL

BACKGROUND OF THE INVENTION

1. Field of the Invention

This invention relates to a mobile applicator for receiving and positioning semi-rigid panels in an arcuate arrangement. More particularly, it is concerned with an applicator for ceiling panels which must be raised into position in a substantially smooth archway for reflecting light into a light tunnel.

2. Description of the Prior Art

In final finishing and inspection of many manufactured goods, it is often desirable to have a skin or body without blemishes and a smooth and even protective coating of paint. This is particularly true of automobiles, which command an increasingly higher price and for which the purchaser expects to receive a high level of finish. To meet this consumer demand, automobile manufacturers have instituted inspection processes to examine the fit and finish of the automobile as it leaves the assembly line. The automobile is examined for defects such as dimpled or damaged body panels, poor fit, or unsatisfactory paint applications. At various times, these inspections may be tactile, visual, or both.

To improve the inspection process, it is desirable that the product, particularly an automobile, be properly illuminated. The light must be directed onto the automobile with sufficient brilliance, but also evenly and without glare. Proper illumination enhances the ability of the inspectors to focus their attention on imperfections which might otherwise escape detection because the inspector is blinded by glare, the presence of shadows, or uneven lighting which may inhibit the ability of the inspector to discover faded or discolored surfaces due to variations in pigment, application or during application of a final clear coat. There has developed a need for an improved lighting environment to permit better inspections. Concomitantly, there has developed a need for an apparatus capable of erecting the lighting facility to provide this environment.

SUMMARY OF THE INVENTION

The need for such an apparatus is largely met by the applicator of the present invention. The applicator hereof is intended for efficiently placing panels on the ceiling of a light tunnel while maintaining proper orientation and curvature of the panels. The applicator receives the semi-rigid panels on a frame and raises them into position for securement by adhesive or mechanical fasteners onto the framework of the light tunnel.

The applicator hereof broadly includes a gantry, an arched frame received in the gantry, and a shifter for vertical translation of the arched frame relative to the gantry. More particularly, the gantry includes a plurality of towers each including a pair of tower legs for receiving the arched frame therebetween. The gantry also includes a base including a wheeled carriage for supporting the towers and for permitting horizontal movement of the gantry for the placement of successive, side-by-side panels in the light tunnel. The frame includes a pair of arched rails connected at the feet of the rails by a bridge, with the rails supporting a platform on which the panels may be placed. The platform presents an arched ladderwork configuration having pad material which receives the panels thereon during lifting. The arched platform need not extend the over the entire arcuate reach of the rails, with the additional, normally lower portions of the rails covered with the padding material, which inhibits both marring of the panels and slippage along or off the platform or rails.

The shifter preferably includes a cable and pulley system which enables the frame to be raised upwardly by the use of a winch or winches. The cable extends upwardly from the winches to the tops of the tower legs and then to the bridge of the frame. By winding the cable onto the winch or winches, the length of the cable is shortened and the frame is moved upwardly. As a result, the panels may be maintained in the desired arcuate presentation as the platform and frame permit the semi-rigid panels to be extending for attachment to the tunnel framework in the desired presentation and orientation.

As a result, the applicator for ceiling panels of a light tunnel is lightweight yet sturdy, easily movable to a new position on its wheeled carriage without requiring removal of the frame, and permits efficient alignment of the panels prior to raising into position to form a ceiling. These and other advantages will be readily apparent to those skilled in the art with reference to the drawings and descriptions set forth below.

DESCRIPTION OF THE PREFERRED EMBODIMENT

Figures 4, 11:
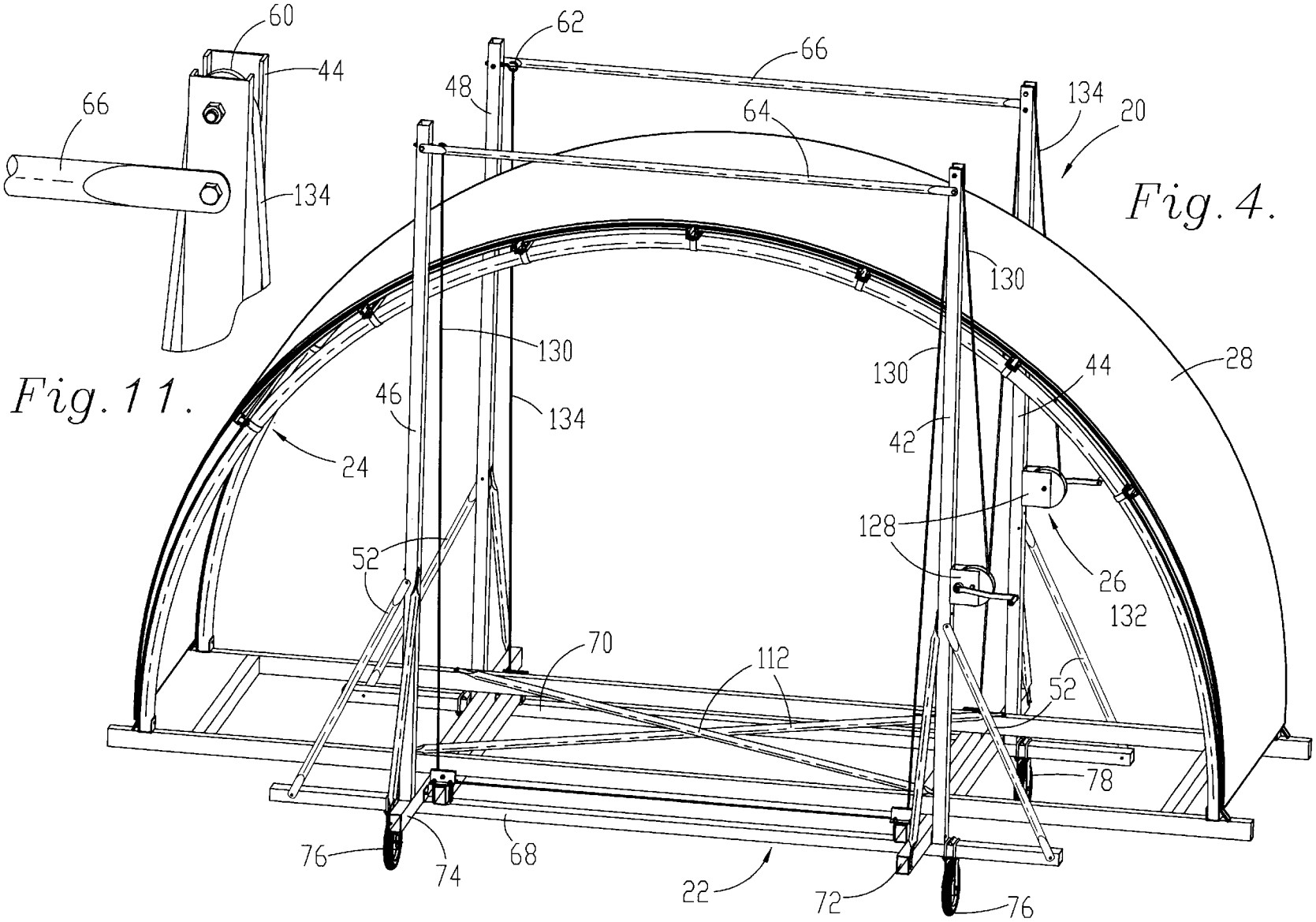
FIG. 4 is a top front perspective view similar to FIG. 1 but showing the placement of the ceiling panel on the frame.
FIG. 11 is an enlarged fragmentary perspective view of an upper portion of another tower leg showing one lifting cable routed over a pulley.
Figure 5:
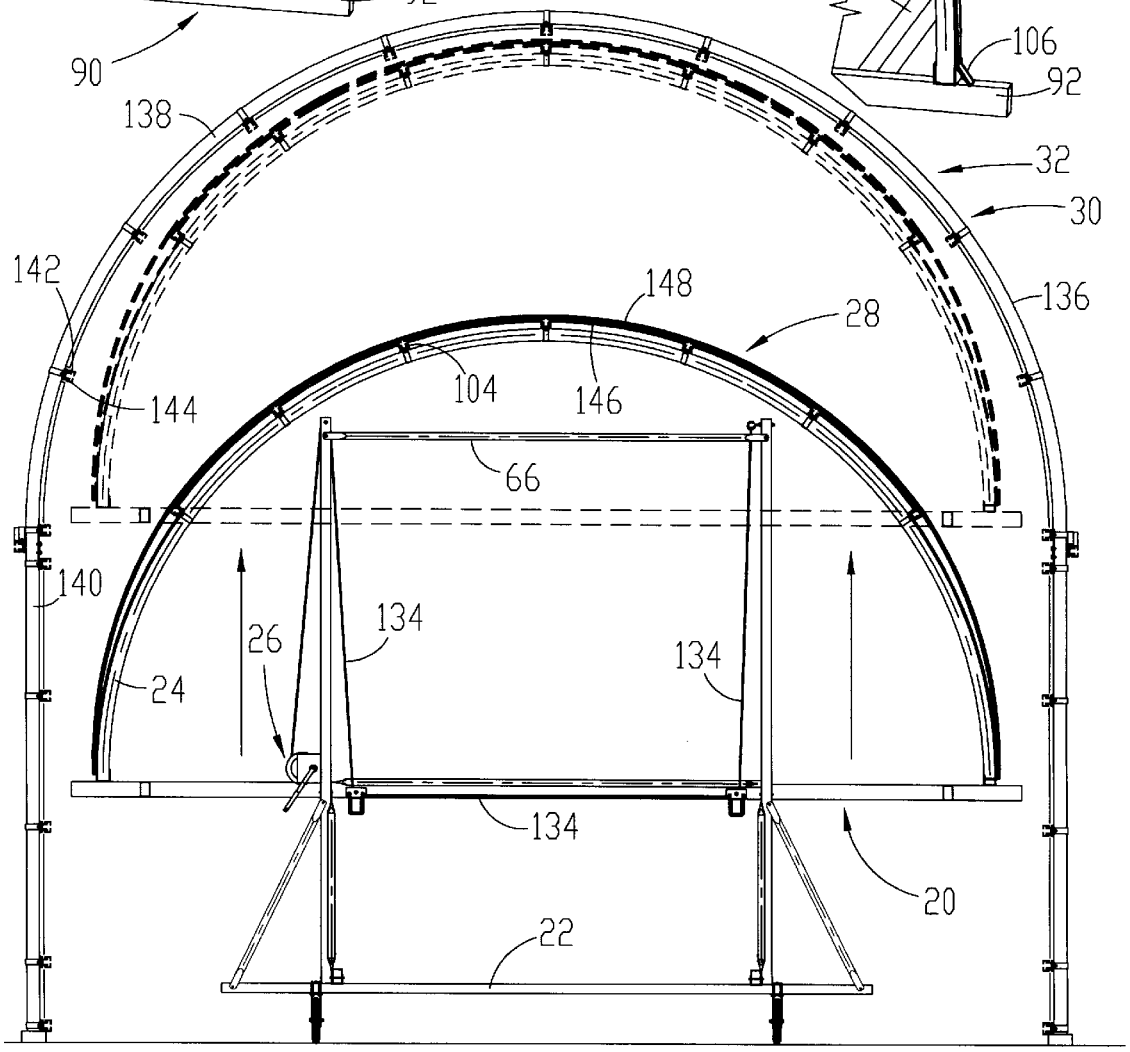
FIG. 5 is a side elevational view of the applicator hereof within a framework of a light tunnel, with the frame and platform shown receiving a ceiling panel thereon and then in phantom lines shown shifted vertically into attachment position.

Referring now to the drawing, an applicator 20 in accordance with the present invention broadly includes a gantry 22, a frame 24, and a shifter 26 for raising and lowering the frame 24 relative to the gantry 22. As shown in FIGS. 4 and 5, the applicator 20 is useful for receiving a semi-rigid ceiling panel 28 on the platform when the applicator 20 is received within a framework 30 of a light tunnel 32 and then raising the panel 28 in an arcuate cross-sectional configuration into proximity of the framework 30 and attaching the panel 28 to the framework 30 to provide a smooth, continuous, arcuate ceiling which reflects light into the interior of the light tunnel 32.

Figures 1, 10:
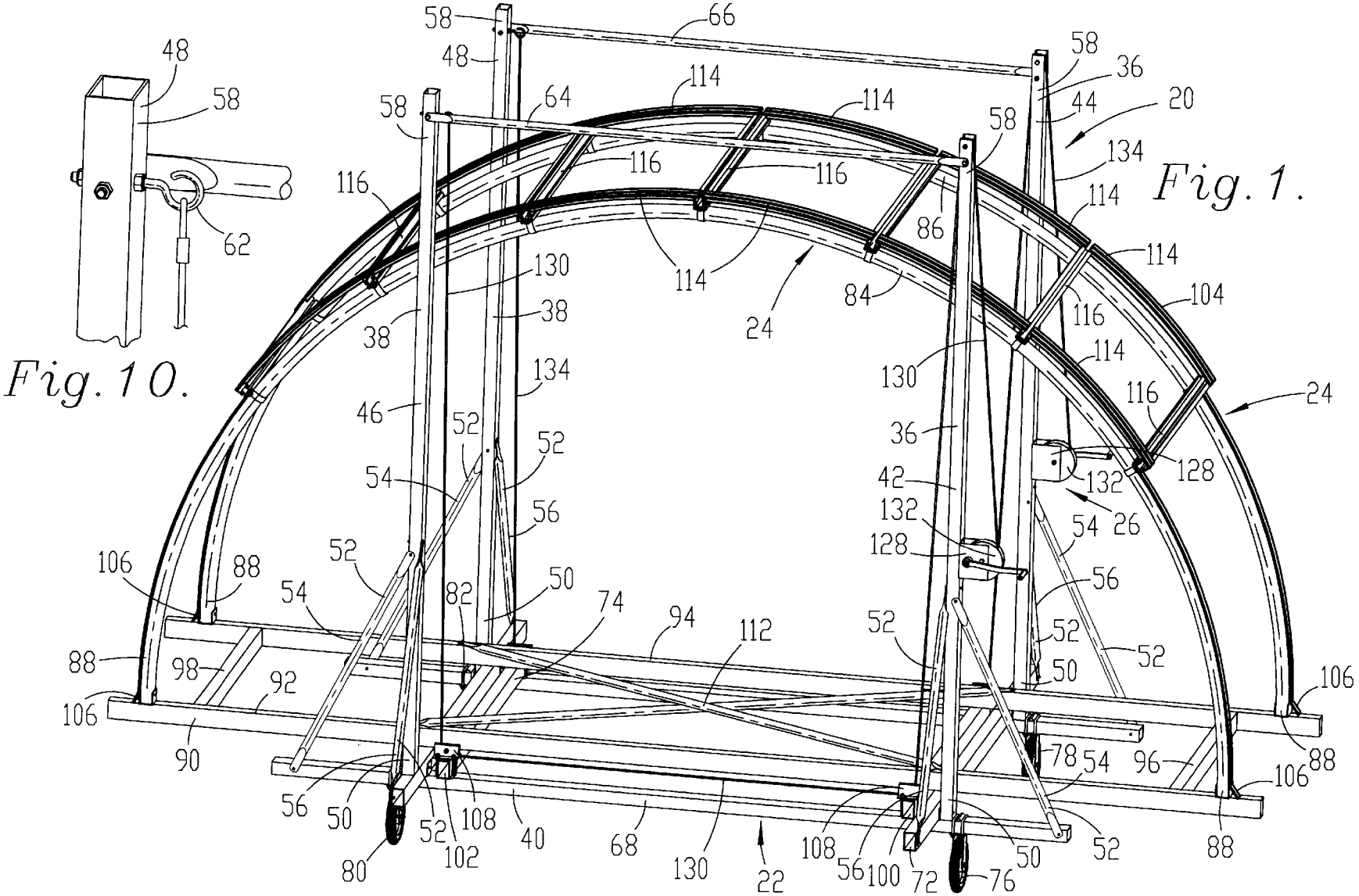
FIG. 1 is a top front perspective view of an applicator for ceiling panels of a light tunnel in accordance with the present invention showing the gantry, the frame, and the shifter for translating the frame upwardly on the gantry.
FIG. 10 is an enlarged fragmentary perspective view of an upper portion of one of the tower legs showing a hook for receiving a lifting cable end.
Figure 2:
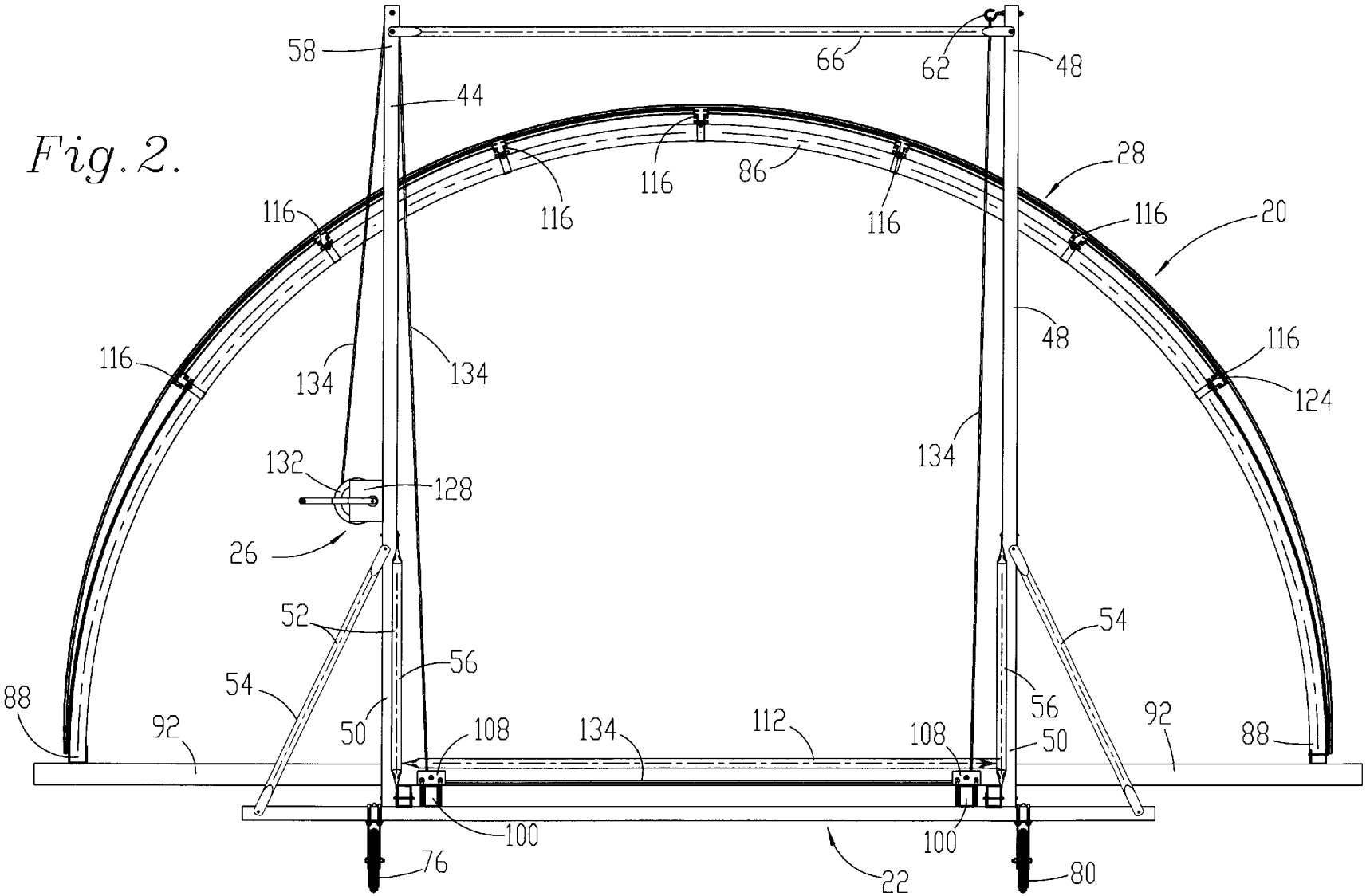
FIG. 2 is a front elevational view thereof.
Figure 8:
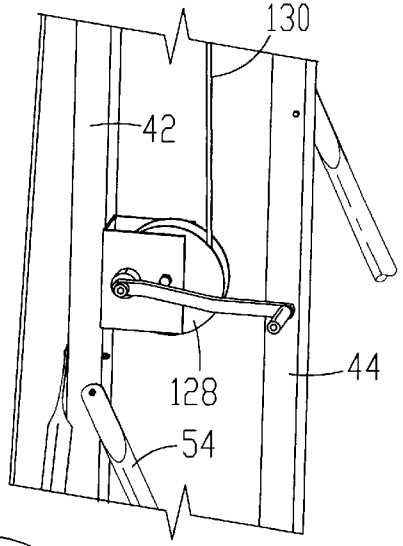
FIG. 8 is an enlarged fragmentary perspective view of the applicator showing a winch of the shifter positioned on one tower leg.

In greater detail, the gantry 22 includes a pair of generally upright towers 36 and 38 and a base 40. A first tower 36 includes a pair of spaced-apart upright tower legs 42 and 44, and second tower 38 also includes a pair of spaced-apart upright tower legs 46 and 48. The tower legs 42, 44, 46 and 48 are connected at their lower ends 50 to the base 40 and are supported by braces 52 which are angularly oriented relative to the legs. The braces 52 include struts 54 which are generally co-planar with a vertical plane within which each tower 36 and 38 lies, and supports 56 which are generally normal to the plane of the struts 54. The tower legs 42, 44, 46 and 48 also include upper ends 58. The upper ends 58 of the legs 42 and 44 of the first tower rotatably mount pulleys 60 therein as shown in FIG. 11. The upper ends 58 of the legs 46 and 48 of the second tower 38 mount fasteners 62, for example hooks 64 as shown in FIG. 10 although other fasteners may be used. The first tower 36 is also interconnected to the second tower 38 by spreaders 64 and 66. Spreader 64 is fastened by bolts or the like to the upper ends 58 of legs 42 and 46 and spreader 66 is similarly fastened by bolts or the like to the upper ends of legs 44 and 48, as shown in FIG. 1.

The base 40 of the gantry 22 includes a pair of joists 68 and 70 interconnected and maintained in spaced relationship by headers 72 and 74. The joists 68 and 70 are spaced apart a sufficient distance so that legs 42, 44, 46 and 48 are connected at their lower ends to joists 68 an 70 to thereby receive the frame 24 between the tower legs. Wheeled carriages 76, 78, 80 and 82 are mounted on the joists 68 and 70 to permit the base to roll across a floor or other supporting structure. The struts 54 are connected at their lower ends to the joists 68 and 70 while the supports 56 are connected at their lower ends to headers 72 and 74.

Figure 9:
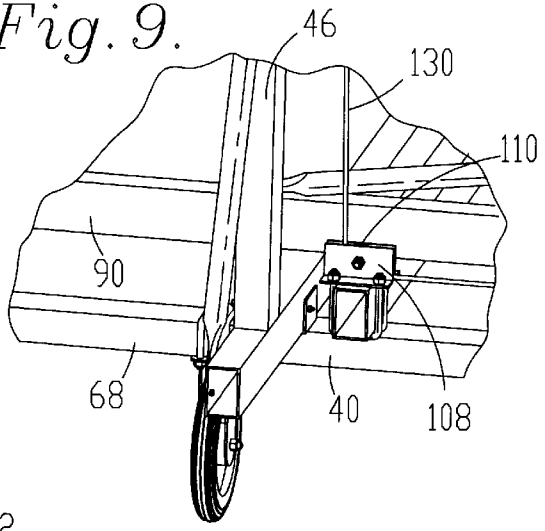
FIG. 9 is an enlarged fragmentary perspective view of the applicator showing a portion of the bridge of the frame including a lifting girder carrying a pulley, and a portion of the carriage of the gantry.

The frame 24 includes a pair of generally arcuate, upright rails 84 and 86 each presenting terminal feet 88, a bridge 90 including a pair of chords 92 and 94 connected to the feet 88, a pair of cross-beams 96 and 98 interconnecting the chords 92 and 94 and maintaining the latter in spaced parallel planar relationship, a pair of lifting girders 100 and 102, and a platform 104. The rails 84 and 86 are each upwardly convex. A flange 106 is angled at the feet 88 and diagonally bridges between the rails 84 and 86 and the chords 92 and 94. The lifting girders 100 and 102 are generally transverse to the chords 92 and 94 and the rails 84 and 86 and mount thereon lifting brackets 108 including idler pulleys 110 as shown in FIG. 9. The rails are preferably welded to the bridge, with the chords welded to the cross-beams and the lifting girders. Stays 112 are placed in a crossing relationship to further interconnect and stabilize the chords 92 and 94.

Figure 12:
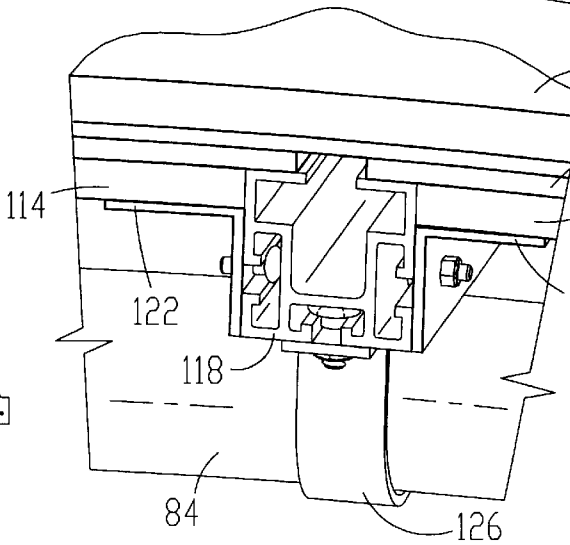
FIG. 12 is an enlarged fragmentary perspective view of the frame showing the platform attachment to one of the rails of the frame.
Figure 3:
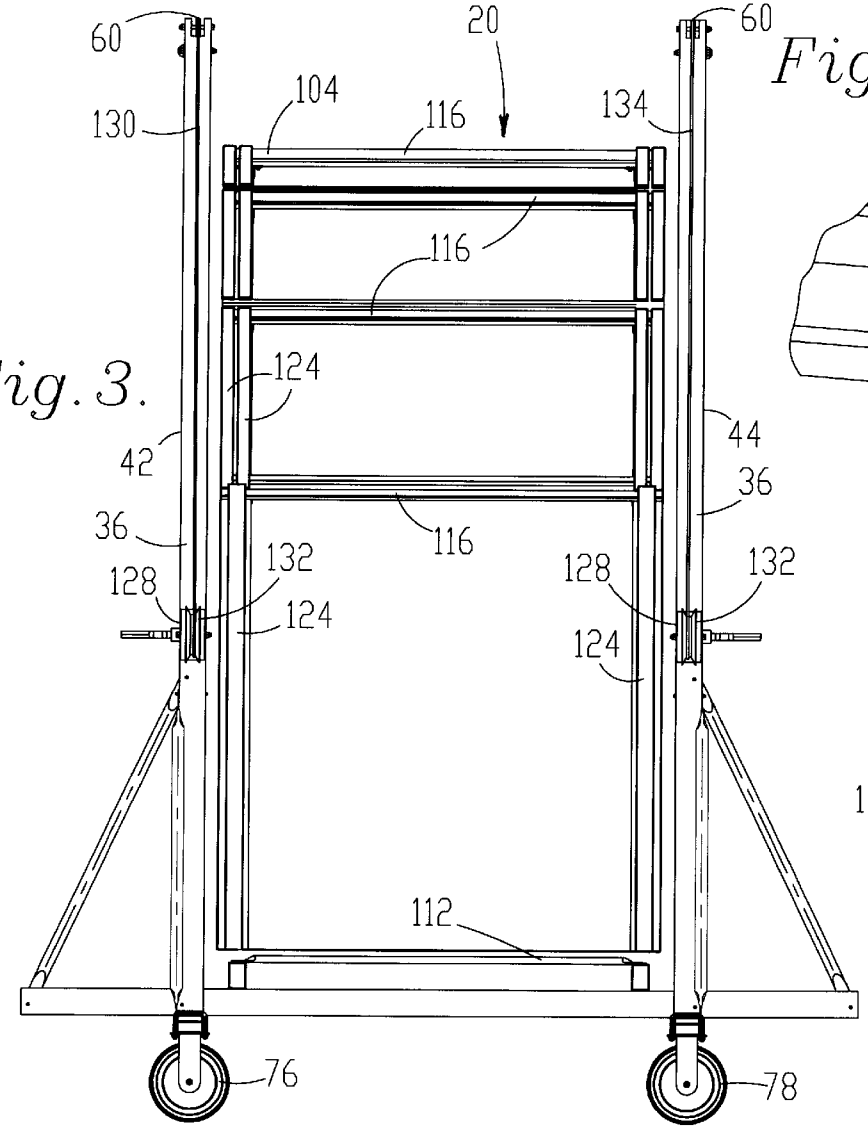
FIG. 3 is a side elevational view thereof.

The platform 104 is mounted on the uppermost portion of the rails 84 and 86 and includes a plurality of arcuate segments 114 interconnected by tie beams 116 circumferentially spaced along the rails 84 and 86. As shown in FIG. 12, the tie beams 116 are internally slotted box channels 118 carrying diverging mounting flanges 120 and 122 externally thereon. The mounting flanges 120 and 122 are connected to the channels 118 by bolts received in the internal slots and in turn mount arcuate segments 114 by bolts, screws or the like on the upper facing portions of the flanges. A strip of pad material 124, such as felt, is secured by adhesive or the like to the outward face of the arcuate segments for receiving a panel 28 thereon. The tie beams 116 are attached along the rails 84 and 86 by straps 126 secured by bolts or screws to the tie beams 116.

Figure 6:
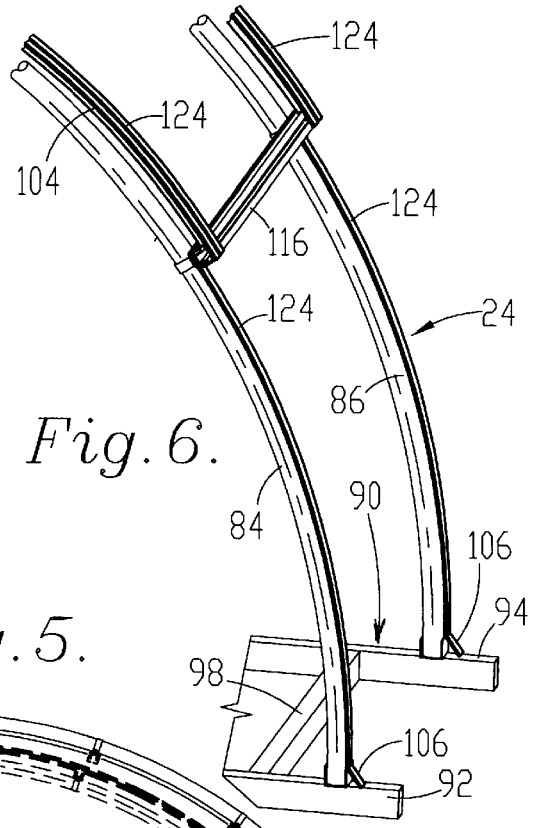
FIG. 6 is an enlarged perspective view showing the lower portion of one end of the frame without the ceiling panel positioned thereon.

The shifter 26 includes first winch 128 with first cable 130 received thereon and second winch 132 with second cable 134 received thereon. The first winch 128 is mounted to tower leg 42 and second winch 132 is mounted to tower leg 44 as illustrated in FIG. 6. The first and second cables 130 and 132 are routed over pulley 60 at the upper end of legs 42 and 44 respectively, beneath idler pulleys 110 spaced laterally on each of the lifting brackets 100 and 102, and then are affixed to fasteners 62 at the upper end 58 respectively of each of tower legs 46 and 48 of second tower 38.

Figure 7:
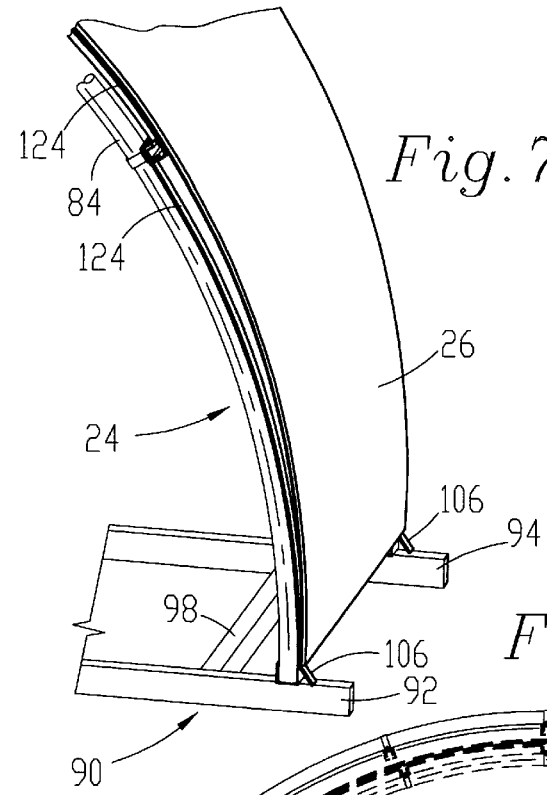
FIG. 7 is an enlarged perspective view similar to FIG. 6 showing the lower portion of a ceiling panel supported by the frame.

The pad material 124 is also pieceably secured to the upper surface of the lower portions of the rails 84 and 86 so that portions of the rails 84 and 86 extending outwardly and below the platform 104 is covered by the pad material 124. The pad material 124 also extends over the flanges 106 as shown in FIGS. 6 and 7.

The applicator 20 hereof is intended for use in light tunnel 32 having a framework 30 as shown in FIG. 5. The framework includes an outer structure 136 having a plurality of arch members 138, preferably of steel pipes, supported on upright posts 140 and inner assembly 142 is positioned within the outer structure 136 which includes a plurality of horizontally extending stringers 144 extending the length of the light tunnel 32 together with suitable braces to provide rigidity. The ceiling panels 28 present an inner, reflective surface 146 intended to be received on the frame 24 and a second surface 148 which may be adhesively secured to the inner assembly 142 to the light tunnel 32. The light tunnel includes suitable light sources which are oriented towards the reflective surface 146 of the panels 28 to provide even and direct lighting. Suitable panels useful in such a light tunnel are available, for example, as Kydext Sheets from Kleerdex Company of Aiken, S.C.

In use, the applicator 20 is wheeled beneath the framework 30 of the light tunnel 32 into proper position for raising a ceiling panel 28 into position. A ceiling panel 28 is then placed with its inner reflective side 46 resting on the platform 104 and extending downwardly over the lower portions of the rails 44 and 46 as shown, for example, in FIGS. 2, 4, 5 and 7. The winches 128 and 132 are then actuated to wind, respectively, the first cable 130 and second cable 134 thereon. As the cables are wound onto the winches, the amount of cable routed over pulley 60 and beneath either pulleys 110 is shortened, causing frame 24 to move upwardly relative to gantry 22. The operator continues to wind the winches 128 and 132 to move the frame and thus the ceiling panel 28 upwardly as illustrated in FIG. 5 until the frame 24 carrying the panel thereon reaches the position shown in dotted lines in FIG. 5. Thereupon, the operator may affix the second surface 124 to the inner assembly 142 of the framework 30 using doubled sided adhesive tape, liquid adhesive, or mechanical fasteners. Once the adhesive has cured to a sufficient degree and proper adhesion has been obtained, the winches 128 and 132 are permitted to spool out the cable, thereby permitting lowering of the frame 24. When the frame 24 has been suitably lowered, for example, onto base 40, the gantry 22 may be rolled along the floor horizontally to receive a second ceiling panel 28 thereon and again raise the frame 24 so that the second ceiling panel may be placed in juxtaposition to the first ceiling panel. The process is repeated until all of the ceiling panels 28 have been attached to the framework 30 of the light tunnel 32.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the literal scope of the invention as set out in the following claims.

What is claimed is:

1. An applicator for ceiling panels of a light tunnel comprising:

a gantry comprising a plurality of towers and a support base, each of said towers including a pair of elongated upright tower legs;

a frame received on said gantry and positioned between the tower legs of each tower, said frame including a pair of spaced-apart upwardly generally arched rails each presenting a pair of feet and a bridge interconnecting said feet; and a shifter operatively interconnecting said gantry and said frame and serving to raise said frame relative to said gantry.

2. An applicator as set forth in claim 1, said gantry including a wheeled carriage for enabling horizontal rolling movement thereof.

3. An applicator as set forth in claim 1, wherein each of said tower legs includes at least one brace angularly oriented relative to said leg and interconnecting said tower leg and said base.

4. An applicator as set forth in claim 3, wherein said shifter includes a pair of winches each having a cable connected thereto and each of said tower legs of a first one of said towers includes an upper end rotatably carrying a pulley for receiving thereon said cable.

5. An applicator as set forth in claim 4, wherein each of said tower legs of a second one of said towers includes a fastener for connecting to one of said cables.

6. An applicator as set forth in claim 5, wherein said bridge includes at least one idler pulley for receiving thereon said cable.

7. An applicator as set forth in claim 1, wherein said frame includes an arched platform connected to said rails, said platform including a generally upward and outward facing pad material for receiving a ceiling panel thereon.

8. An applicator as set forth in claim 7, wherein said platform includes a plurality of arcuate segments each having said pad material thereon.

9. An applicator as set forth in claim 8, wherein said platform extends over and in covering relationship to only along a portion of the arcuate reach of said rails, a remaining portion of each of said rails generally lower than said platform having said pad material thereon.

10. An applicator as set forth in claim 1, said bridge including a pair of chords each interconnecting the feet on opposite ends of each rail and at least one beam for maintaining said chords in spaced relationship.

11. An applicator for ceiling panels of a light tunnel comprising:

a gantry comprising a pair of towers and a support base, said towers each including a pair of elongated spaced apart upright tower legs having an upper end, a lower end connected to said base and at least one supporting brace connected to said base for maintaining said tower legs in an upright orientation, said upper end of each tower leg being connected to another tower leg of another tower by a spreader for maintaining separation between the towers, said base including a plurality of wheels for facilitating horizontal translation of said gantry;

a frame for supporting a ceiling panel thereon, said frame including a pair of upwardly convex generally arcuate rails positioned in upright parallel planes each having a terminal foot, a bridge connected to said feet for supporting said rails thereon, and a platform mounted to and over at least a portion of said rails, said platform including an arcuate panel support having slip-resistant pad material thereon; and a shifter for raising and lowering said frame relative to said gantry, said shifter including at least one winch mounted on said gantry and at least one cable in engagement with each of said towers and said frame, whereby winding said cable onto said winch raises said frame relative to said gantry.

12. An applicator as set forth in claim 11, said platform including a plurality of arcuate segments generally above and coplanar with said rails and having said pad material thereon.

13. An applicator as set forth in claim 12, a first one of said towers including a pulley rotatably mounted at the upper end of each of said tower legs, a second one of said towers including a fastener at the upper end of each of said tower legs, said bridge including a pair chords each interconnecting the feet of one of said rails, said chords each mounting a pair of idler pulleys in spaced relationship therealong, said shifter including a pair of winches having a cable connected thereto, said cable for each of said winches passing over a respective one of said pulleys on one of the tower legs of said one tower, beneath the idler pulleys mounted on said chords, and being connected to a respective one of said fasteners at the upper end of a tower legs of said second tower.

14. A method for mounting ceiling panels in a light tunnel comprising the steps of:

providing a light tunnel having a framework defining a generally arcuate ceiling configuration;

providing a plurality of semi-rigid panels each having at least one light reflective side and a second side for mounting to the interior of the framework ceiling of a light tunnel;

providing a applicator for ceiling panels having a gantry, a generally arcuate frame, and a shifter for vertically shifting said frame relative to said gantry;

positioning one of the panels on the frame of the applicator whereby the one panel assumes an arcuate vertical cross-sectional configuration with its light reflective side facing generally downwardly;

shifting said frame relative to said gantry to raise the panel in said arcuate configuration into proximity to said framework; and attaching said panel to said framework with said one reflective side facing generally downwardly.

15. A method as set forth in claim 14, wherein said panel is adhesively attached to said framework.

16. A method as set forth in claim 14, including the additional steps of lowering said frame, shifting said gantry horizontally, and repeating said positioning, shifting and attaching steps to attach a second panel to said framework in juxtaposition to said first panel.

* * * * *